US006909842B2

(12) United States Patent
Dufour

(10) Patent No.: US 6,909,842 B2
(45) Date of Patent: Jun. 21, 2005

(54) INSTANTANEOUS COMPACT FLUID HEATER

(75) Inventor: Denis Dufour, Saint-Romuald (CA)

(73) Assignee: DDA Énergie LTÉE, Saint-Romuald (CA)

( * ) Notice: Subject to any disclaimer, the term of this patent is extended or adjusted under 35 U.S.C. 154(b) by 0 days.

(21) Appl. No.: 10/482,162

(22) PCT Filed: Jul. 5, 2002

(86) PCT No.: PCT/CA02/01034

§ 371 (c)(1),
(2), (4) Date: Feb. 20, 2004

(87) PCT Pub. No.: WO03/004939

PCT Pub. Date: Jan. 16, 2003

(65) Prior Publication Data

US 2004/0197093 A1 Oct. 7, 2004

(30) Foreign Application Priority Data

Jul. 6, 2001 (GB) ..... 0116515

(51) Int. Cl.[7] ..... H05B 3/78
(52) U.S. Cl. ..... 392/447; 392/497; 392/498
(58) Field of Search ..... 392/441, 449, 392/447, 497, 498

(56) References Cited

U.S. PATENT DOCUMENTS

| | | | |
|---|---|---|---|
| 3,952,182 | A | 4/1976 | Flanders |
| 4,459,465 | A | 7/1984 | Knight |
| 4,900,896 | A | 2/1990 | Maus |
| 5,408,578 | A | 4/1995 | Bolivar |
| 5,438,642 | A | 8/1995 | Posen |

FOREIGN PATENT DOCUMENTS

| | | | |
|---|---|---|---|
| AU | 56713 69 | A | 12/1970 |
| GB | 985 962 | A | 3/1965 |
| WO | WO 97 24014 | A | 7/1997 |

*Primary Examiner*—Thor S. Campbell

(57) ABSTRACT

A fluid heater including a reservoir, an inlet-conduit assembly and an outlet conduit. The reservoir contains fluid and includes heating elements. The inlet-conduit assembly is mounted to the reservoir and has an inlet-aperture and is in communication with the reservoir at an opposite end. The outlet conduit is mounted to the reservoir and is in communication with the reservoir at one end and has an outlet-aperture at an opposite end. A fluid-flow detector assembly is mounted to one of the inlet-conduit assembly and outlet conduit. A heating element modulator is mounted to the inlet-conduit assembly. The heating element modulator is connected to the heating elements. A thermal sensor is mounted to at least one of the inlet-conduit assembly, reservoir and outlet conduit. A controller is connected to the heating element modulator, to the fluid-flow detector assembly and to the thermal sensor. The fluid enters the inlet-conduit assembly through its inlet-aperture causing the fluid-flow detector assembly to instruct the controller to activate the heating elements via the heating element modulator. The fluid into the reservoir to be heated by the heating elements and out of the reservoir into the outlet conduit towards the outlet-aperture.

33 Claims, 5 Drawing Sheets

INSTANTANEOUS COMPACT FLUID HEATER

FIELD OF THE INVENTION

The present invention relates to a fluid heater. More specifically, the present invention is concerned with an instantaneous compact water heater for selectively heating water.

BACKGROUND OF THE INVENTION

Conventional fluid and water heaters include a tank or reservoir containing a predetermined amount of water into which a heating element is positioned. The water inside the tank is maintained at a predetermined temperature so that it is easily available upon demand. A drawback with the conventional water heater is that there is a loss of valuable energy by heat convection out of the tank or reservoir.

Accordingly, various structures have been proposed to minimize such heat loss.

U.S. Pat. No. 3,952,182 issued to Flanders on Apr. 20, 1976 teaches a miniature instantaneous electric fluid heater adaptable to be mounted immediately in advance of a hot water faucet. The heater includes a fluid-holding heating vessel having at least one heating element to heat the fluid and having an inlet assembly at its bottom end and an outlet assembly at its top end.

U.S. Pat. No. 4,459,465 issued to Knight on Jul. 10, 1984 teaches an instantaneous fluid heater having a fluid inlet, a plurality of heating chambers having heating elements and a fluid outlet. The heating chambers are interconnected by means of laterally extending passageways.

U.S. Pat. No. 4,900,896 issued to Maus on Feb. 13, 1990 teaches a continues flow heater having a sealed chamber containing an electrical heating element and a diaphragm having an orifice through which water must flow upon demand. The centre of the diaphragm translates axially in response to the water flow and moves an internal magnet, which influences an external magnet to throw a flow switch.

U.S. Pat. No. 5,438,642 issued to Posen on Aug. 1, 1995 teaches an instantaneous water heater having an inlet cylinder for receiving water from a supply and an outlet cylinder to discharge heated water. A plurality of heat exchange chambers is formed between the inlet and outlet cylinders. The chambers are positioned in a row and to allow for water to flow in a serpentine manner therethrough. The chambers include heaters controlled by triacs. The inlet cylinder includes a magnet that rises in response to water to close a reed switch in order to turn the power on.

A drawback with the prior art is inefficiency, high cost and complicated design.

There thus remains a need for an improved water heater.

OBJECTS OF THE INVENTION

An object of the present invention is therefore to provide an improved water heater.

SUMMARY OF THE INVENTION

More specifically, in accordance with the present invention, there is provided a fluid heater comprising:

a reservoir for containing fluid and including heating elements positioned therein;

an inlet-conduit assembly mounted to the reservoir having an inlet-aperture at one end and being in communication with the reservoir at an opposite end;

an outlet conduit mounted to the reservoir and being in communication with the reservoir at one end and having an outlet-aperture at an opposite end;

a fluid-flow detector assembly mounted to one of the inlet-conduit assembly and outlet conduit;

a heating element modulator mounted to the inlet-conduit assembly, the heating element modulator being connected to the heating elements;

a thermal sensor mounted to at least one of the inlet-conduit assembly, reservoir and outlet conduit;

a controller connected to the heating element modulator, to the fluid-flow detector assembly and to the thermal sensor;

whereby, fluid enters the inlet-conduit assembly through its inlet-aperture causing the fluid-flow detector assembly to instruct the controller to activate the heating elements via the heating element modulator; the fluid then flows into the reservoir to be heated by the heating elements and out of the reservoir into the outlet conduit towards the outlet-aperture.

In accordance with another aspect of the invention there is provided a body for a fluid-heater, the body comprising:

a reservoir defining a cavity for receiving fluid and heating elements therein and including an open end;

a inlet-conduit assembly mounted to the reservoir and having an inlet aperture at one end and being in fluid communication with the reservoir cavity at another end, the inlet-conduit assembly being configured to receive a heating element modulator; and an outlet conduit mounted to the reservoir and having one end in fluid communication with the reservoir and an outlet aperture at an opposite end;

wherein at least one of the inlet-conduit assembly and outlet conduit is configured to receive a fluid-flow detector assembly and at least one of the inlet-conduit assembly, reservoir and outlet conduit is configured to be connected to a thermal sensor.

An advantage of the present invention is that the water heater is compact and takes up less space as compared to, prior water heaters.

Another advantage of the present invention is that the water heater may selectively heat water upon demand.

A further advantage of the present invention is that it minimizes loss of energy out of the reservoir.

A further advantage of the present invention is that the water heater while meeting conventional norms is of simple construction, relatively easy to use and economical.

Other objects, advantages and features of the present invention will become more apparent upon reading of the following non restrictive description of preferred embodiments thereof, given by way of example only with reference to the accompanying drawings.

BRIEF DESCRIPTION OF THE DRAWINGS

In the appended drawings like reference numerals denote like elements throughout and in which.

DESCRIPTION OF AN EMBODIMENT OF THE INVENTION

With reference to FIGS. 1 to 8 an embodiment of the present invention will be herein described.

Figure 1:
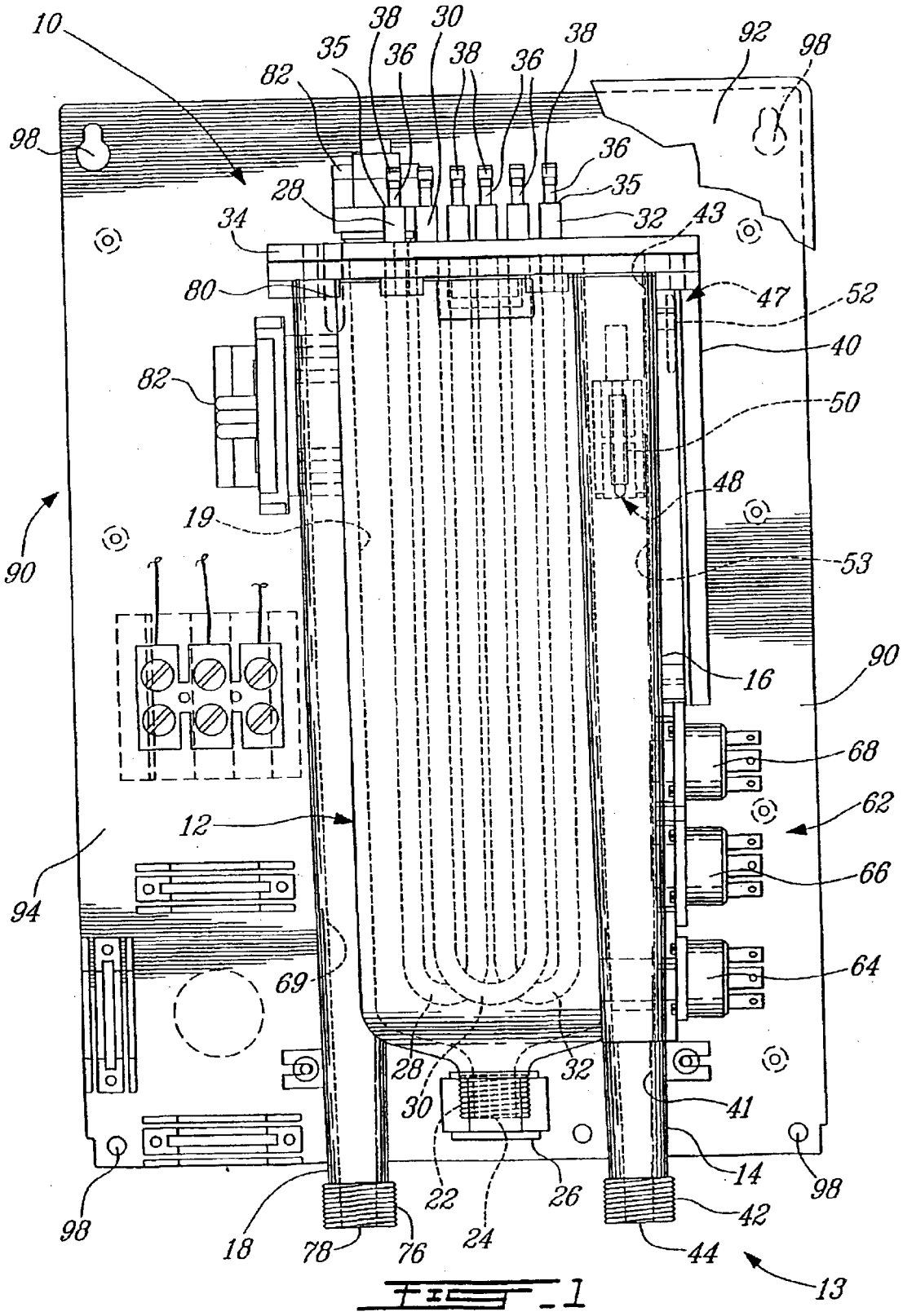
FIG. 1 is an elevational broken front view of the fluid heater in accordance with an embodiment of the present invention.
Figure 2:
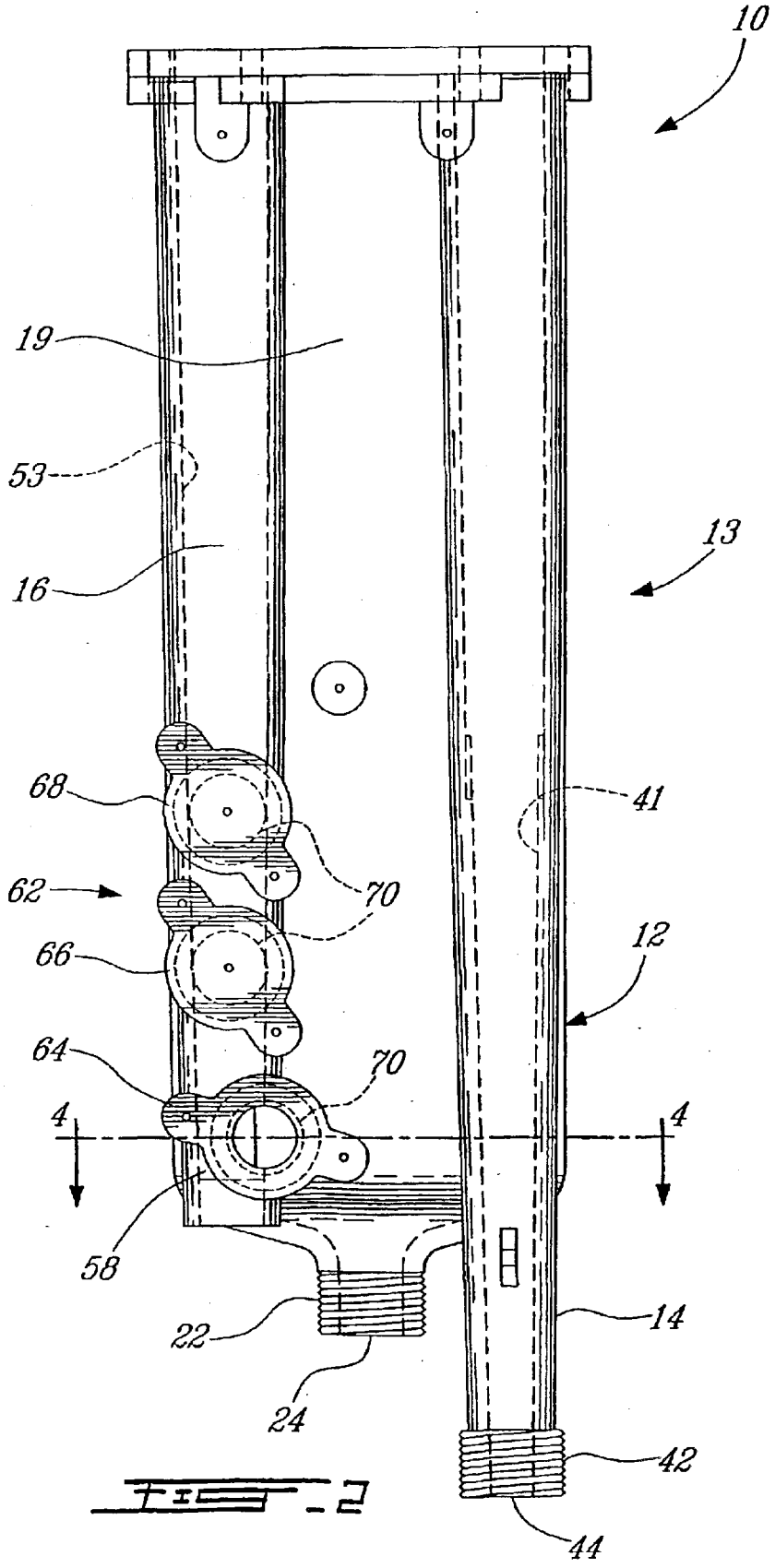
FIG. 2 is an elevational side view of the fluid heater of FIG. 1.

Referring to FIGS. 1 and 2 there is shown a fluid heater 10 including a fluid-containing reservoir 12, an inlet-conduit assembly 13 and an outlet conduit 18. In this embodiment, the inlet-conduit assembly 13 includes an inlet conduit 14 and an auxiliary conduit 16 (FIG. 2). Together, the foregoing components form a body 11 (see FIG. 7) for a fluid heater 10.

It should be noted that the term "reservoir" could be construed herein to mean a tank, a water guard or any like water containing body as is known in the art.

In most cases, the fluid to be heated by the present fluid heater 10 is water, nevertheless the invention is not limited to the heating of water but may be used to heat other fluids as can be contemplated by the skilled artisan. Therefore, for the purpose of the present disclosure the terms "water" and "fluid" are interchangeable.

The reservoir 12 is an elongated cylindrical tank defining a single elongated cavity or chamber 19 (see FIGS. 3, 4 and 7) configured to contain water to be heated as will be explained below. Reservoir 12 has an open top end 20 (see FIGS. 3 and 7) and an opposite threaded bottom end 22 defining a drainage aperture 24 which is kept closed during use by a complementary threaded cap 26.

FIG. 1 shows heating elements 28, 30 and 32 positioned within the reservoir 12. The heating elements 28, 30 and 32 are secured to a cover 34 (see FIG. 6), which is mounted to the reservoir 12 as will be explained below. Each heating element 28, 30, 32 has a compact configuration in order to minimize the space it occupies inside the reservoir while meeting the standards and norms of common practice. In this particular example, the heating elements 28, 30 and 32 are in colloidal, sheathed type and travel in an 'S'. Each heating element 28, 30 and 32 extends beyond cover 34 and terminates with a respective rod 36 beyond each of its two sheathed ends 35 (also see FIG. 6). Each rod 36 is soldered by a tab 38 (also see FIG. 6).

Figure 8:
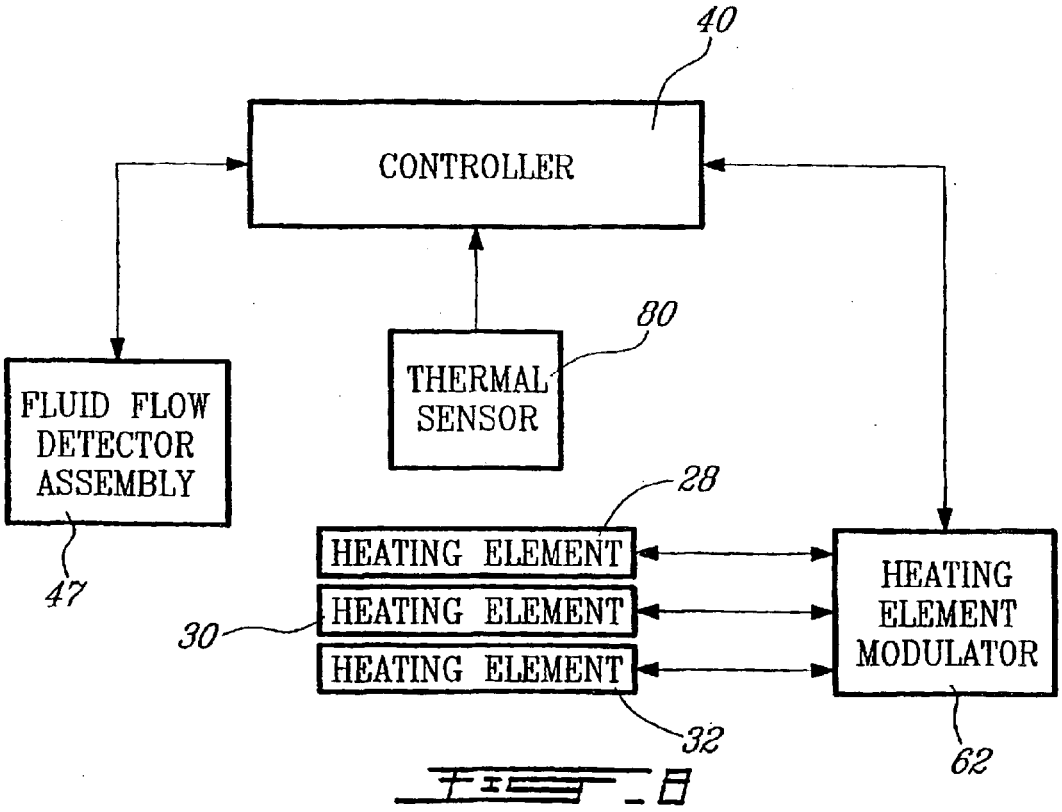
FIG. 8 is a schematic drawing showing the controller being mounted to various components of the present invention.

With reference to FIGS. 1 and 8, the heating elements 28, 30 and 32 are electrically connected to a controller 40 via a heating element modulator, as will be explained herein.

The inlet conduit 14 is a longitudinal member such as a pipe defining a channel 41 and positioned along the length of the reservoir 12. The inlet conduit 14 has a threaded bottom end 42 defining an inlet-aperture 44 and an exit aperture 46 at its top end 43 (see FIGS. 3 and 7).

As shown in FIG. 1, a fluid-flow detector assembly 47 is positioned in the inlet conduit 14 and mounted to the controller 40 (also see FIG. 8).

The fluid-flow assembly 47 includes a flow-detector 48 in the form of a floatable shuttle or flow switch placed within the inlet conduit 14. Shuttle 48 includes a magnet 50.

The fluid-flow assembly 47 also includes a sensor 0.52 mounted to the inlet conduit 14 at a predetermined position near the exit-aperture 46. Sensor 52 is configured to be signalled by the flow detector 48 as will be explained below. The sensor 52 is in the form of magnetic contact switch or reed switch. Sensor 52 is mounted to the controller 40 so as to transmit data thereto.

Figure 3:
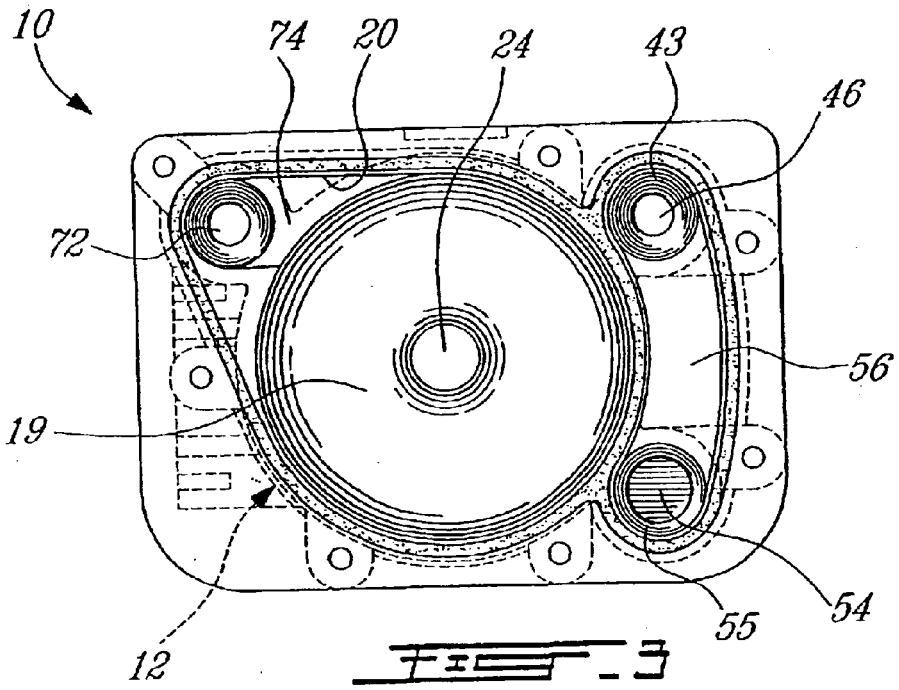
FIG. 3 is a top plan view of the fluid heater of FIG. 1, shown without a cover and heating elements.
Figure 4:
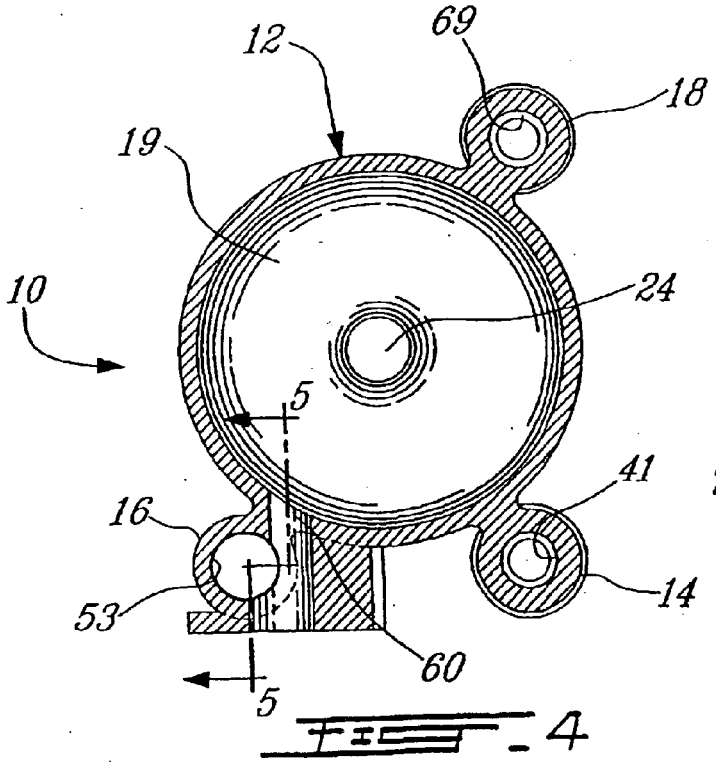
FIG. 4 is a sectional view of FIG. 2 taken along line 4—4.
Figure 5:
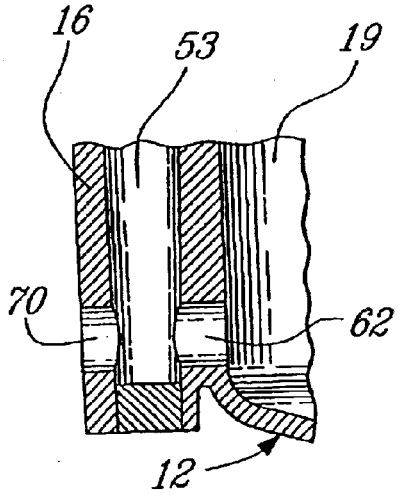
FIG. 5 is a sectional view of FIG. 4 taken along line 5—5.
Figure 7:
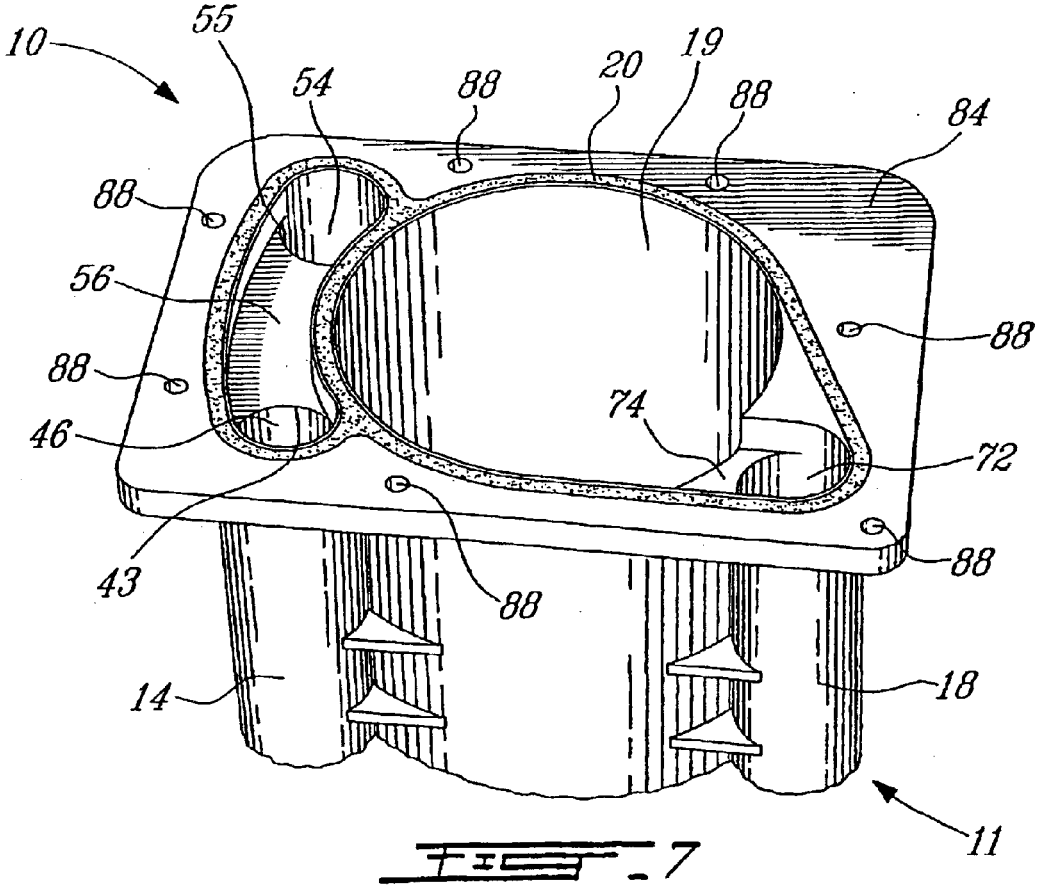
FIG. 7 is a partial perspective view of the fluid heater of FIG. 1, shown without a cover and heating elements.

As can be seen from FIG. 2, the auxiliary conduit 16 is a longitudinal member such as a pipe defining a channel 53 and positioned along the length of the reservoir 12 opposite the inlet conduit 14. As shown in FIGS. 3 and 7, the auxiliary conduit 16 has an aperture 54 at its top end 55 which is communication with the inlet conduit exit-aperture 46 via a channel 56 formed therebetween which provides for channel 41 to be contiguous with channel 53. With reference to FIGS. 2, 4 and 5, the auxiliary conduit 16 has a bottom portion 58 in communication with the reservoir 12 via a reservoir entry-aperture 60 which provides for channel 53 to be contiguous with cavity 19.

Water to be heated may thus flow from the inlet 44, through conduits 14 and 16 to reach the reservoir cavity 19.

With reference to FIGS. 1 and 2, the auxiliary conduit 16 is connected to a heating element modulator 62 in such as way as to expose the heating element modulator to cold water as will be explained when the invention is described in operation.

With reference to FIG. 8, the heating element modulator 62 is connected to the controller 40.

The heating element modulator 62 is in the form of triacs 64, 66 and 68. Each triac 64, 66 and 68 is mounted to the auxiliary conduit 16 in a respective triac-aperture 70 allowing each triac 64, 66 and 68 to communicate with the auxiliary channel 53.

Each triac 64, 66 and 68 is connected to a respective heating element 28, 30 and 32 for modulation thereof. For example, triac 64 is electrically connected to heating element 28, triac 66 is electrically connected to heating element 30 and triac 68 is electrically connected to heating element 32. The triacs 64, 66 and 68 control the electrical current that is supplied to the heating elements 28, 30 and 32 as commanded by the controller 40 and as will be discussed herein.

The outlet conduit 18 is a longitudinal pipe member defining a channel 69 and positioned along the length of the reservoir 12 on a side thereof that is opposite both the inlet and auxiliary conduits 14 and 16 respectively. The outlet conduit 18 has a top end aperture 72 that is in communication with the reservoir top open end 20 via a channel such as duct 74 (see FIGS. 3 and 7) formed therebetween which provides from cavity 19 to be contiguous with channel 69. As shown in FIGS. 1 and 2, the outlet conduit 18 has a threaded bottom end 76 defining an outlet-aperture 78.

With reference to FIGS. 1 and 8 the outlet conduit includes a thermal sensor such as a temperature probe 80 which is also connected to controller 40. As shown in FIG. 1, the thermal sensor 80 is mounted in channel 69 near aperture 72. The thermal sensor 80 is configured to detect the temperature of water flowing through the outlet conduit 18 and to transmit this data to the controller 40.

A thermostat 82 in the form of a disk type thermostat is mounted to the fluid heater 10. The thermostat 82 is manually operated and configured to disengage electrical supply to the heater elements 28, 30 and 32 as will be discussed hereinbelow.

As shown, the thermostat 82 may be mounted to the cover 34 or the reservoir 12. In the latter case, the reservoir 12 includes a thermostat-aperture (not shown) for receiving thermostat 82.

With reference to FIGS. 3 and 7 the reservoir 12, inlet, auxiliary and outlet conduits 14, 16 and 18 respectively are joined together at their top ends by a common plate 84.

Figure 6:
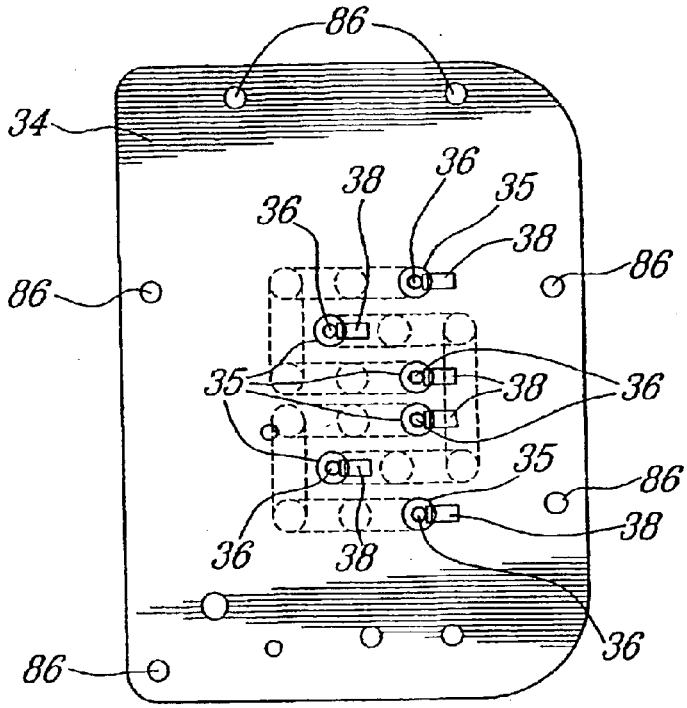
FIG. 6 is a top plan view of the fluid of FIG. 1.

As shown in FIG. 6, the cover 34 has a configuration that is complementary to plate 84 and is mountable thereto by way of fasteners (not shown) mountable in cover screw holes 86 which correspond to plate screw holes 88. In this way cover 34 covers the reservoir open end 20, the inlet conduit exit-aperture 46, the auxiliary conduit aperture 54, the channel 56, the outlet conduit top end aperture 72 and the duct 74.

The fluid heater 10 is mounted in an enclosure 90 in the form of a box having a removable front cover or door 92 to allow easy access thereto and a back panel 94. Enclosure 90 also includes apertures at its bottom end which respectively provide for the inlet conduit end 42 and the outlet conduit end 76 to extend beyond the enclosure bottom end 96. The enclosure 90 is mountable to a wall surface (not shown) via screw holes 98 in back panel 94.

Keeping the above description in mind, the invention will now be described in operation.

The fluid heater 10 is mounted to a wall surface (not shown) within the enclosure 90. The controller 40 is connected to a power supply (not shown) supplying power to the fluid heater 10 as is known in the art.

A cold water supply pipe (not shown) is screwed onto the threaded end 44 of the inlet conduit 14 and a hot water outlet pipe (not shown) is screwed onto the threaded end 76 of the outlet conduit 18.

Cold water (not shown) from the supply pipe enters the inlet conduit 14 through the inlet-aperture 44. The water upwardly flows inside channel 41 of the inlet conduit 14 causing the floatable shuttle 48 to rise therewith. The shuttle 48 reaches the position of the magnetic contact switch 52 and closes it. Hence, when the shuttle magnet 50 and the switch 52 are in magnetic contact, the controller 40 is notified by switch 52 and activates the heating elements 28, 30 and 32 as well as the triacs 64, 66 and 68.

The water flows out of the inlet conduit through its exit-aperture 46 and is directed towards the auxiliary conduit 16 via channel 56. The water enters the auxiliary conduit 16 through its top end aperture 54. As shown, apertures 46 and 54 are adjacent and communicate via the short channel 56, this provides for there being no dead ends during water flow hence, permitting fluid flow without trapping air.

This cold water downwardly flows in the auxiliary conduit channel 53 to directly communicate with the activated triacs 64, 66 and 68, which are cooled down thereby.

When the triacs 64, 66 and 68 are activated they will tend to over heat; the configuration of the auxiliary conduit is advantageous since it counteracts this overheating factor by allowing cold water to cool the triacs 64, 66 and 68 down.

The water then enters the reservoir 12 through aperture 60 (see FIGS. 2, 4 and 5) and upwardly fills the fluid containing chamber or reservoir 12 to be heated by the heating elements 28, 30 and 32. The foregoing configuration avoids depositing minerals at the bottom of the reservoir 12.

Hot water then flows towards the outlet conduit 18 via duct 74. The hot water enters the outlet conduit 18 through its top end aperture 72 and downwardly flows in its channel 69. As shown in FIG. 7, reservoir open end 20 and aperture 72 are adjacent and communicate via the short channel or duct 74, this provides for there being no dead ends during water flow hence, permitting fluid flow without trapping air.

The thermal sensor 80 determines the temperature of the hot water and transmits this data to the controller 40. Once the controller receives his information it will signal the triacs 64, 66, and 68 to modulate the heating elements 28, 30 and 32 accordingly to either increase or decrease their heating temperature. Hence, triac 64 modulates the current sent to heating element 28, triac 66 modulates the current sent to heating element 30 and triac 68 modulates the current sent to heating element 32. Therefore the heating temperature of the elements 28, 30 and 32 is adjusted according to the temperature of the water flowing through the auxiliary conduit 18. Hence, the modulating triacs 64, 66 provide to maintain the heating temperature of the elements 28, 30 and 32 constant regardless of water flow.

The hot water is discharged from the water heater 10 though outlet aperture 78 and enters the outlet pipe.

The disk type thermostat 82, which has a manual reset mechanism, allows for independent protection in the event that water temperature rises exceedingly high. The thermostat 82 is adapted to automatically disengage the electrical supply to the heating elements 28, 30 and 32 should this condition occur and must be manually reset before the water heater 10 is functional again.

When water is no longer required, shutting off the water supply arrests its flow into the fluid heater 10. As water ceases to flow into the inlet conduit 14, the floatable shuttle 48 will descend by gravity disengaging the switch 52, which notifies the controller 40 to stop the heating operation.

If the period of non-usage is prolonged, the reservoir may be drained of any excess water remaining by removing the cap to allow water to escape from the drainage aperture 24.

Therefore, fluid heater 10 according to the present invention provides for selectively heating fluid upon demand. Fluid does not need to be maintained in the reservoir 12, it can continually flow though the heater 10 while being heated. The simple and compact configuration of the body 11 provides for the present fluid heater 10 to take up less space and to be relatively inexpensive and easy to manufacture. Furthermore, the configuration and constant flow of water through the fluid heater 10 during the heating operation minimizes the loss of energy caused by heat convection out of the reservoir 12.

Having now described an embodiment of the present invention, the following is a non-limiting description of certain alternative embodiments of the present invention.

The reservoir 12, inlet conduit 14, auxiliary conduit 16 and outlet conduit 18 may be an integrated moulded piece forming the body 11. A variety of materials may be used to make the body 11 yet, injected plastic is more convenient to make a one-piece body mould. Advantageously, engineering plastic is used. Advantageously, the material used should be able to withstand high temperatures and pressures. It is of course advantageous to use non-rusting material. Of course, the reservoir 12, inlet conduit 14, auxiliary conduit 16 and outlet conduit 18 may be separate pieces that are mounted together to form the body 11.

The reservoir 12 may be provided in a variety of shapes and sizes known in the art. What is important is that it provides a space for water to be heated in accordance with the present invention.

The drainage aperture 24 may be configured to receive a reservoir temperature and pressure release valves.

The heating elements 28, 30 and 32 may be positioned within the reservoir 12 in a variety of ways known in the art. Furthermore, the heating elements 28, 30 and 32 need not be secured to cover 34 but may be mounted directly to the reservoir as can be contemplated by the skilled artisan. The heating elements 28, 30 and 32 may be provided in a number of configurations and may be of various types known in the art. What is important is that they be positioned within the reservoir 12 so as to heat the fluid in accordance with the present invention. In this example there are three heating elements, yet more or less heating elements may be provided.

It should be noted that when selecting the configuration of the reservoir 12 and the heating elements 28, 30 and 32 that increasing the contact of the fluid with the heating elements is advantageous. In the example illustrated, the configuration of reservoir 12 and its corresponding fluid-containing chamber 19 as well as the disposition and configuration of the heating elements 28, 30 and 32 provide for sufficient contact between the aforementioned elements and the fluid that is to be heated thus, speeding up the heating operation.

The inlet-conduit assembly 13 may be provided in a variety of configurations. The inlet-conduit assembly may 13 include only the inlet conduit 14 which may include both the fluid-flow detector assembly 47 and the heating element modulator 62. In this case, the inlet conduit 14 would be in fluid communication with the reservoir 12.

The inlet conduit 14 may be provided in a variety of configurations and sizes, which provide for letting fluid into the heater 10. The bottom end 42 need not be threaded but may be provided in other configurations capable of being connected to a cold fluid supply.

The shuttle 48 may be provided in a variety of floatable forms. The sensor 52 may be mounted to the inlet conduit 14 in a variety of ways, which provide for magnetic contact between the shuttle magnet 50 and the sensor 52.

The fluid-flow detector 47 may be a flow meter connected to the controller 40 so as to transmit data thereto. The flow meter may upon a minimum fluid flow signal the controller 40 to activate the heating elements 28, 30 and 32. Furthermore, this flow data received by the controller 40 may also permit the controller to instruct the triacs 64, 66 and 68 to modulate the current sent to the heating elements 28, 30 and 32 according to fluid flow in the inlet conduit as well as the fluid temperature in the outlet conduit 18.

It may be contemplated to position the fluid-flow detector assembly 47 in the outlet conduit 18 as well.

Of course, the skilled artisan within the scope of the present invention may contemplate other types of fluid-flow detector assemblies 47. Furthermore, other types of flow detectors 48 and corresponding sensors 52 may be contemplated. What is important is that the fluid-flow assembly 47 used in the present invention signals the controller 40 when fluid enters the inlet conduit 14 in order for the heating operation to commence or that fluid has ceased entering the inlet conduit 14 in order to stop the heating operation.

The channel 56 may also be any other type of communication means between the inlet and auxiliary conduits 14 and 16 which provides for water to flow from the inlet conduit 14 to the auxiliary conduit 16.

The auxiliary conduit 16 may be provided in a variety of suitable configurations and sizes.

Furthermore, the auxiliary conduit 16 bottom portion 58 may be in communication with the reservoir 12 via a porous wall, a plurality of apertures or a channel or any other suitable communication means.

In the illustrated example there are three triacs 64, 66 and 68 each corresponding to a respective heater element 28, 30 and 32. Of course, the number of triacs will vary with the number of heating elements used.

It can be contemplated within the scope of the invention to use other heating element modulators 62 known to the skilled artisan. Whatever type of modulator used its function should be to modulate the temperature of the heating elements in accordance with the temperature and/or flow rate date received by the controller 40 as explained herein.

The outlet conduit 18 can be provided in a variety of sizes and configurations for leading heated water to hot fluid pipe. Furthermore, duct 74 is replaceable by a variety of communication means such as channels, pipes, perforated walls and the like for water to flow from the reservoir 12 to the outlet conduit 18. The bottom end 76 need not be threaded but may be provided in other configurations capable of being connected to a hot water output.

As is apparent to the skilled artisan, a variety and a greater number of thermal sensors or temperature probes 80 can be mounted to the outlet conduit 18 in a variety of ways to detect the temperature of the heated water.

Furthermore, the thermal sensor 80 may be placed in the inlet conduit 14 as well as in the auxiliary conduit 18; in the latter case it should be placed near aperture 54. A thermal sensor 80 may also be placed in the reservoir 12. Hence, the invention may be provided with one, two, three or four thermal sensors and even a flow meter each sending data to the controller 40 for modulation of the heating operation.

Also, depending on the power of the water heater with respect to number of heating elements or heating capacity of the elements more than one as well as various common types of thermostats, such as 82, may be used to disengage electrical supply as explained above.

The common plate 84 may be made of metal or be part of the body mould and hence, can be made of plastic. The plate 84 may be integral to the top portions of the reservoir 12, inlet, auxiliary and outlet conduits 14, 16 and 18 respectively or may be a separate piece configured to join the foregoing components. Of course, the invention may be contemplated without a plate 84.

The cover 34 may be made of strong durable material such as metal or plastic. Depending on the configuration and types of heating elements the cover 34 will be provided with means to either secure the heating elements thereto or to provide that the heating elements be in electrical communication with the controller 40 and/or modulator 62. In the case where a plate 84 is not provided a plurality of covers may be contemplated for reservoir open end 20, the inlet conduit exit-aperture 46, the auxiliary conduit top end aperture 54, the channel 56, the outlet conduit top end aperture 72 and the duct 74.

Enclosure 90 may be provided in a variety of shapes and sizes for enclosing the water heater 10 and allowing easy access thereto. Enclosure 90 is preferably made of plastic, metallic or any other material. Of course the invention may be contemplated without an enclosure 90.

It should also be noted that power may supplied to the heating elements 28, 30 and 32, the triacs 64, 66 and 68 and the controller 40 in a variety of ways known in the art.

The controller 40 may be an electronic control circuit or a programmable data processor, a computer or any type of controller known in the art for the purposes of the present invention.

It is to be understood that while the above description describes a generally vertical heater, one skilled in the art could design a generally horizontal heater within the scope of the present invention using alternative flow-detector assemblies of course. In this latter case the terms top and bottom for describing ends may be replaced by first and second ends.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof; it can be modified, without departing from the spirit, scope and nature of the subject invention as defined in the appended claims.

What is claimed is:

1. A fluid heater comprising:

a reservoir for containing fluid and including heating elements positioned therein;

an inlet-conduit assembly having an inlet-aperture at one end and being in communication with said reservoir at an opposite end;

an outlet conduit in communication with said reservoir at one end and having an outlet-aperture at an opposite end, said outlet conduit including an open top end, said reservoir including an open top end with a passage extending between said outlet conduit and said reservoir open top ends;

a fluid-flow detector assembly mounted to one of said inlet-conduit assembly and outlet conduit;

a heating element modulator mounted to said inlet-conduit assembly, said heating element modulator being connected to said heating elements;

a thermal sensor mounted to at least one of said inlet-conduit assembly, reservoir and outlet conduit;

a controller connected to said heating element modulator, to said fluid-flow detector assembly and to said thermal sensor;

whereby, fluid enters said inlet-conduit assembly through its inlet-aperture causing said fluid-flow detector assembly to instruct said controller to activate said heating elements via said heating element modulator; the fluid then flows into said reservoir to be heated by said heating elements and out of said reservoir into said outlet conduit towards said outlet-aperture.

2. A fluid heater according to claim 1, wherein said inlet-conduit assembly includes an inlet conduit and an auxiliary conduit, said inlet conduit including said inlet-aperture and an opposite exit-aperture, said auxiliary conduit in communication with said inlet conduit exit-aperture at one end and with said reservoir at an opposite end.

3. A fluid heater according to claim 2, wherein said reservoir is an elongated structure with said inlet conduit, said auxiliary conduit and said outlet conduit being longitudinal members positioned on said reservoir.

4. A fluid heater according to claim 3, wherein said auxiliary conduit includes an open top end, a channel being formed between said inlet conduit exit-aperture and said auxiliary conduit open top end.

5. A fluid heater according to claim 4, wherein said inlet conduit exit-aperture and said auxiliary conduit open top end are adjacent.

6. A fluid heater according to claim 2, wherein said fluid-flow detector assembly is mounted to said inlet conduit.

7. A fluid heater according to claim 2, wherein said heating element modulator is mounted to least one of said inlet and auxiliary conduits.

8. A fluid heater according to claim 1, wherein said fluid-flow detector assembly includes a flow detector positioned inside said inlet-conduit assembly and a sensor connected to said controller so as to transmit data thereto and being so positioned and configured as to be signalled by said flow detector.

9. A fluid heater according to claim 8, wherein said flow detector includes a floatable shuttle, said inlet-conduit assembly being so configured that when fluid enters therein it causes said shuttle to rise therewith.

10. A fluid heater according to claim 9, wherein said shuttle includes a magnet, said sensor being a magnetic contact switch, wherein when said shuttle rises it is brought into magnetic contact with said switch so as to activate said heating elements.

11. A fluid heater according to claim 1, wherein said fluid-flow detector assembly includes a fluid flow meter.

12. A fluid heater according to claim 1, wherein said heating element modulator includes at least one triac connected to at least one said heating element.

13. A fluid heater according to claim 1, wherein said inlet-conduit assembly includes a triac-aperture for receiving said triac.

14. A fluid heater according to claim 1, wherein said thermal sensor is configured to detect the temperature of flowing fluid and to transmit this data to said controller.

15. A fluid heater according to claim 1, further comprising a thermostat connected to said heating elements configured to disengage power supply to said heating elements.

16. A fluid heater according to claim 1, wherein said reservoir includes a thermostat-aperture for receiving said thermostat.

17. A fluid heater according to claim 1, further comprising a cover, said reservoir including an open top end, said heating elements being mounted to said cover, said cover being mountable to said reservoir so as to close said open top end.

18. A fluid heater according to claim 1, wherein said reservoir, said inlet-conduit assembly and said outlet conduit form an integrated piece.

19. A fluid heater, according to claim 1, wherein said inlet-conduit assembly is mounted along said reservoir.

20. A fluid heater, according to claim 1, wherein said outlet conduit is mounted along said reservoir, said outlet conduit and said reservoir open top ends being adjacent.

21. A fluid heater according to claim 1, wherein said fluid is water.

22. A body for a fluid-heater, said body comprising:

a reservoir defining a cavity for receiving fluid and heating elements therein and including an open end;

an inlet-conduit assembly mounted along said reservoir and having an inlet aperture at one end and being in fluid communication with said reservoir cavity at another end, said inlet-conduit assembly being configured to receive a heating element modulator; and an outlet conduit mounted along said reservoir and having one end in fluid communication with said reservoir and an outlet aperture at an opposite end;

wherein at least one of said inlet-conduit assembly and outlet conduit is configured to receive a fluid-flow detector assembly and at least one of said inlet-conduit assembly, said reservoir and said outlet conduit is configured to be connected to a thermal sensor.

23. A body according to claim 22, wherein said reservoir, said inlet-conduit assembly and said outlet conduit form a single integrated piece.

24. A body according to claim 23, wherein said single integrated piece is made of non-rusting material.

25. A body according to claim 22, wherein said inlet-conduit assembly includes an inlet conduit and an auxiliary conduit, said inlet conduit including said inlet-aperture and an opposite exit-aperture, said auxiliary conduit being in communication with said inlet conduit exit-aperture at one end and with said reservoir at an opposite end.

26. A body according to claim 25, wherein said reservoir is an elongated structure with said inlet conduit, said auxiliary conduit and said outlet conduit being longitudinal members positioned on said reservoir.

27. A fluid heater according to claim 26, wherein said auxiliary conduit includes an open top end, a channel being formed between said inlet conduit exit-aperture and said auxiliary conduit open end.

28. A fluid heater according to claim 27 wherein said inlet conduit exit-aperture and said auxiliary conduit open end are adjacent.

29. A body according to claim 22, wherein said outlet conduit includes an open end, a channel being formed between said opposite said outlet conduit open end and said reservoir open end.

30. A body according to claim 29, wherein said outlet conduit open end and said reservoir open end are adjacent.

31. A body according to claim 22, wherein said reservoir, inlet conduit, auxiliary conduit and outlet conduit top ends are joined together by a plate member.

32. A body according to claim 22, wherein said body further includes a cover, said cover being mountable to said reservoir open end complementary to said plate member and mountable thereto.

33. A body according to claim 31, wherein said cover is configured to receive said heating elements.

* * * * *